US007536747B2

(12) United States Patent
Christeson et al.

(10) Patent No.: US 7,536,747 B2
(45) Date of Patent: May 26, 2009

(54) HINGE SHIM AND SHEET THEREOF

(76) Inventors: Michael E. Christeson, 260 Las Alturas Rd., Santa Barbara, CA (US) 93103; Michael Macko, 3840 Pueblo Ave., Santa Barbara, CA (US) 93110

( * ) Notice: Subject to any disclaimer, the term of this patent is extended or adjusted under 35 U.S.C. 154(b) by 0 days.

(21) Appl. No.: 11/021,934

(22) Filed: Dec. 23, 2004

(65) Prior Publication Data

US 2006/0137140 A1 Jun. 29, 2006

(51) Int. Cl.
*E05D 7/04* (2006.01)

(52) U.S. Cl. ..... 16/247

(58) Field of Classification Search ..... 16/247–248, 16/235, 382, 385, 387–388; D8/323, 354; 428/33, 43, 99, 131, 192; 248/188.2; 52/98, 52/518, 523, 217

See application file for complete search history.

(56) References Cited

U.S. PATENT DOCUMENTS

| | | | | | |
|---|---|---|---|---|---|
| 2,154,716 | A | * | 4/1939 | Anderson | 16/247 |
| 2,239,433 | A | * | 4/1941 | Urbain | 254/104 |
| 3,229,323 | A | * | 1/1966 | Hensgen | 16/247 |
| 3,892,902 | A | * | 7/1975 | Ilukowicz | 428/99 |
| 4,336,879 | A | * | 6/1982 | Carr | 206/323 |
| 4,516,364 | A | * | 5/1985 | Heider | 52/98 |
| 4,639,971 | A | * | 2/1987 | Kurtz | 16/247 |
| 4,662,553 | A | * | 5/1987 | Grosjean | 225/103 |
| D291,406 | S | * | 8/1987 | McNeese | D8/323 |
| 4,731,965 | A | | 3/1988 | Jensen | |
| 4,817,794 | A | * | 4/1989 | Workman | 206/372 |
| 5,853,838 | A | * | 12/1998 | Siems et al. | 428/43 |
| 5,953,862 | A | | 9/1999 | Earhart et al. | |
| 6,018,916 | A | | 2/2000 | Henry | |
| 6,058,671 | A | | 5/2000 | Strickland | |
| 6,062,517 | A | * | 5/2000 | Torres et al. | 248/188.2 |
| 6,155,004 | A | | 12/2000 | Earhart et al. | |
| 6,230,446 | B1 | | 5/2001 | Chalich | |

FOREIGN PATENT DOCUMENTS

| | | | |
|---|---|---|---|
| DE | 2639048 | A * | 2/1978 |
| DE | 19624558 | C1 * | 7/1997 |
| EP | 984218 | A1 * | 3/2000 |
| JP | 08193453 | A * | 7/1996 |
| JP | 09177416 | A * | 7/1997 |
| JP | 2004257057 | A * | 9/2004 |
| JP | 2004270189 | A * | 9/2007 |

* cited by examiner

*Primary Examiner*—Chuck Y. Mah
(74) *Attorney, Agent, or Firm*—Edwin Tarver; Lawson & Tarver LLP

(57) ABSTRACT

An improved plastic hinge shim or work piece that allows for quick alignment of a door is claimed. The hinge shim is an elongated tapered hard plastic body wherein each hinge shim has transverse break lines so that segments can be broken off. Additionally, the hinge shims are molded in a sheet of a plurality of shims such that they can be folded to form a thicker hinge shim as required for application. The slots provided for the hinge mounting screws permit the hinge shim(s) to be moved further into the cavity or out toward the hinge pin to provide for finer adjustment. These hinge shims can easily slip into the cavity under the hinge without the need for trimming. Moreover, the center slot for the hinge screw is open to the thin edge to permit the hinge shim to be inserted into the cavity without removing the center screw.

10 Claims, 4 Drawing Sheets

HINGE SHIM AND SHEET THEREOF

CROSS-REFERENCE TO RELATED APPPLICATION

None

FEDERALLY SPONSORED RESEARCH

Not Applicable

SEQUENCE LISTING OR PROGRAM

Not Applicable

BACKGROUND OF THE INVENTION

1. Field of Invention

The present invention pertains to plastic hinge shims and to a sheet of such shims or like work pieces.

2. Prior Art

In the construction of buildings, both commercial and residential, tapered work pieces, such as shims, are commonly used. Shims are used to fill gaps and are placed under the hinges to align items such as doors or windows in their jamb, or to adjust such items to fit properly. Thus, they avoid use of plane or sanding of such items, which would then require refinishing.

Wood shims have long been the material of choice in many construction projects, particularly for residences due to its availability, being inexpensive and relative ease to work with. However, conventional wood shims have certain deficiencies that provide room for improvement. First, wood pieces of this size can split or splinter relatively easily, especially if forced into position and/or struck with a hammer or tool. Splitting or splintering can defeat the purpose of the shim and can cause safety problems. Second, the inherent properties of wood, being relatively porous, cause wood to compress, especially if substantial forces are applied against it, which can defeat the purpose of the shim. Third, as an organic material, wood can decay or degrade over time. Fourth, although relatively easy to handle and alter in size, wood shims still require tools and substantial handling, which is time-consuming.

In the past, shims were typically fashioned from cardboard boxes or nail boxes, to slip under the hinge and thus change the door's alignment to the jamb. However, cardboard shims are inherently weak and expose the door to settling as the cardboard shims compress. Meanwhile, in the case of metal shims, such shims lack adjustability due to its single thickness and inflexible properties.

Often times, shims are nailed into place so as not to fall or slide, especially when an exact location must be maintained. Accordingly, wooden shims cannot always be held by a nail, thereby resulting in a shim that falls or will not maintain a constant location. Meanwhile, plastic shims firmly can be secured in place by a nail or screw without splitting or compromising its position.

In U.S. Pat. No. 5,953,862 a plastic shim is disclosed. However, its shape and design is not that of the common shim acceptable for conventional construction purposes. In U.S. Pat. No. 6,155,004, a tapered plastic shim and a sheet of such shims is disclosed. However, such shims do not have features to move them further into a cavity under a hinge or out towards a hinge pin. Moreover, a group of such shims cannot be folded together to form a thicker shim required for application, since they cannot be readily broken lengthwise for separation or detachment from the sheet.

Hence, it is a principle object of the present invention to overcome the problems and deficiencies in the art.

BACKGROUND OF THE INVENTION—OBJECTS AND ADVANTAGES

It is an object of the invention to provide a work piece of tapered design in which either the thin or thick edge of the hinge shim can be inserted first to provide movement of the hinge pin toward or away from the doorjamb.

It is another object of the invention to provide a work piece that will easily slip into the cavity under the hinge without the need for trimming to fit into the cavity.

Another object of the invention is to provide an improved work piece, which is of uniform size and shape, of homogeneous consistency, of dependable quality, so that it does not split or break easily or unintentionally.

A further object of the invention is to provide an improved work piece of such dimensions, hardness, nailability, durability, surface friction, and other characteristics as are especially suited for use as hinge shims and which overcome the disadvantages of cardboard, metal or wooden shims.

Still another object of the invention is to provide a work piece in sheets, wherein the sheets are convenient and durable for transport, storage, and handling and can be neatly, cleanly, and easily separated into individual work pieces when ready to use such that their work surfaces are flat and unencumbered with break-off fragments.

Another object of the invention is to provide a work piece, which is tapered to a nearly sharp edge while retaining sufficient strength to maintain its integrity during transport, storage, and use.

Yet another object of the invention is to provide a sheet of work pieces, which can be readily broken off the sheet lengthwise into single or a pair of work pieces transversely for forming the appropriate thickness required for application.

These and other objects will become apparent from the accompanying drawings and the description, which follows.

SUMMARY

The present invention provides an improved plastic shim or work piece useful in the construction industry. Each work piece is a tapered hard plastic body with a thicker section and a thinner section and has special characteristics for its intended purpose. Thus, the work pieces are manufactured to be of uniform size and shape, of homogeneous consistency, and of dependable quality so that they do not change with time. Moreover, they are of such dimensions, hardness, and other characteristics as are especially suited for use as a hinge shim or other work piece and which overcome the disadvantages of other types of shims.

DRAWINGS—FIGURES

DRAWINGS—REFERENCE NUMERALS

11 Hinge Shims

12A Slots

12B Center Slots
13 Score Lines
14A Thicker Section
14B Thinner Section

DETAILED DESCRIPTION—PREFERRED EMBODIMENT

Figure 1:
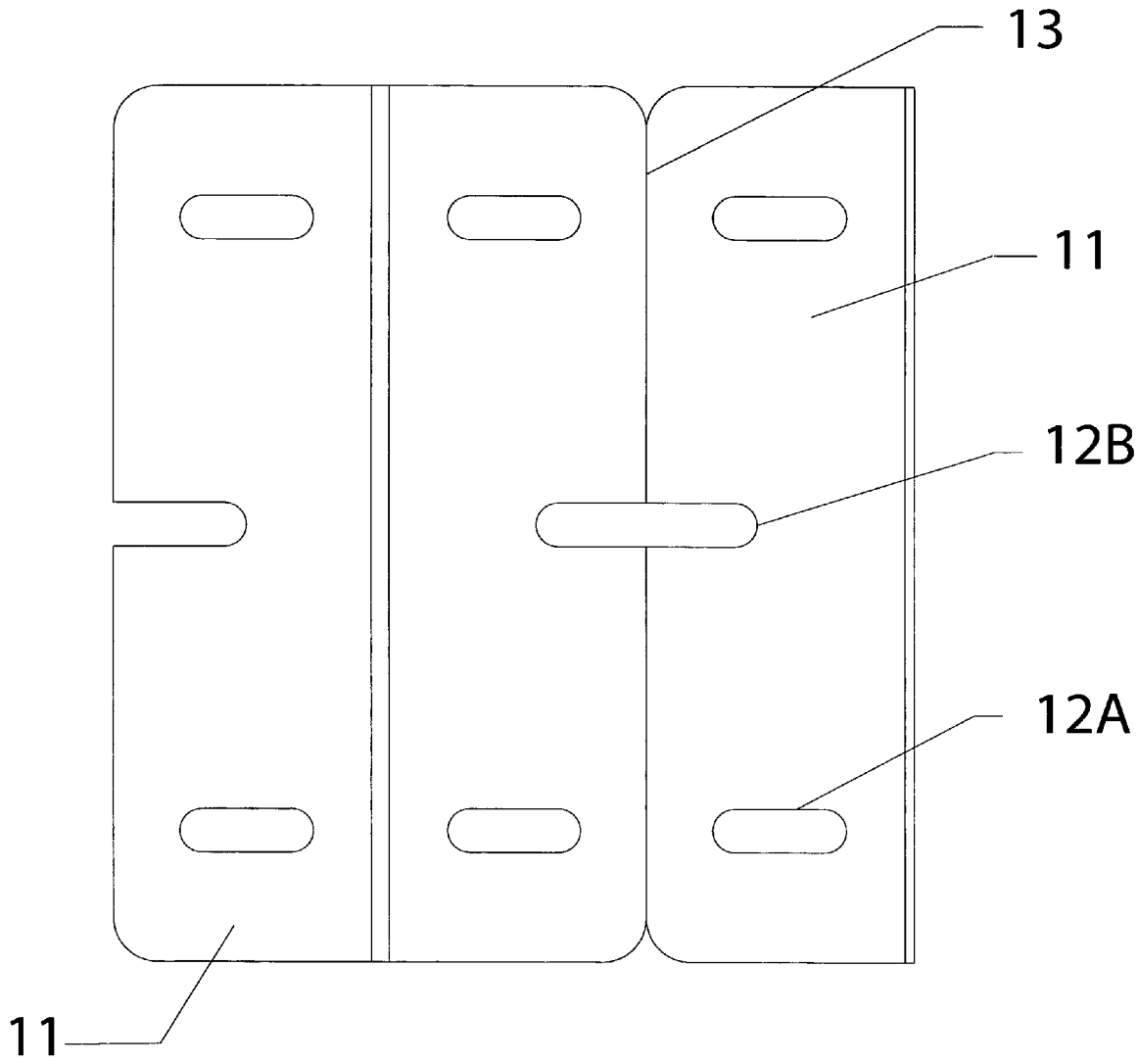
FIG. 1 is a planar view of the front surface of a type A hinge shim in accordance with the present invention.
Figure 2:
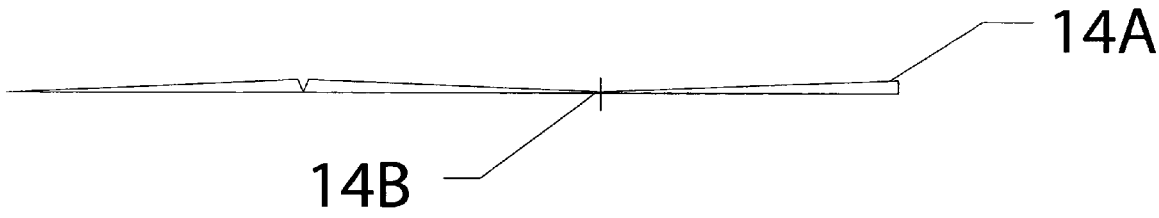
FIG. 2 is a planar view of the top surface of the type A hinge shim and a detailed view thereof.
Figure 3:
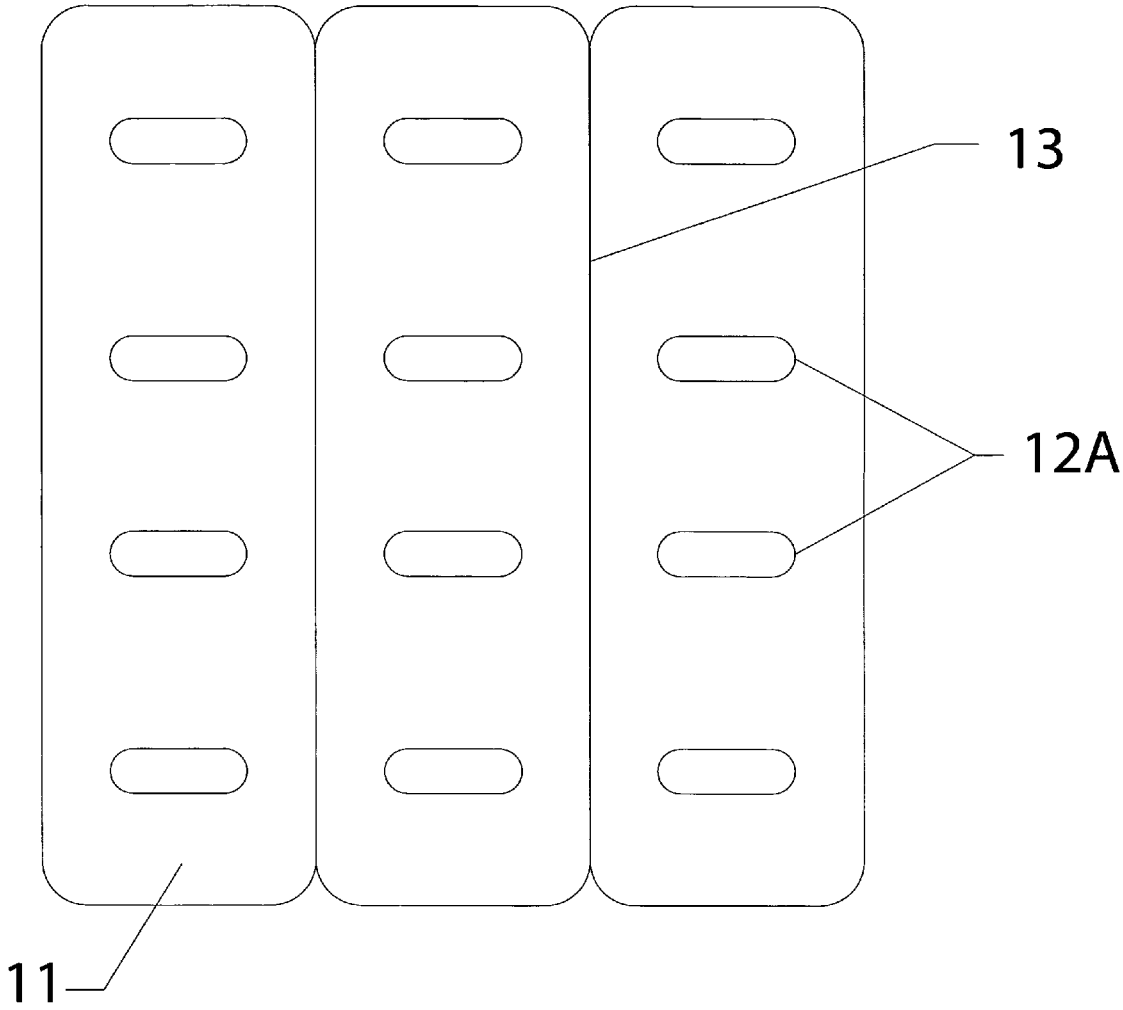
FIG. 3 is a planar view of the front surface of a type B hinge shim in accordance with the present invention.

Referring to FIGS. 1-4, the principles of the present invention are incorporated in a hinge shim 11. FIGS. 1 and 3 refer to type A and type B hinges, respectively. The shim is molded of plastic material, such as polystyrene, polypropylene or high impact polystyrene, that is hard, durable, of high strength and impact resistance, and of homogeneous consistency. The shim has opposite, flat, rectangular front and back shimming surfaces.

Figure 4:
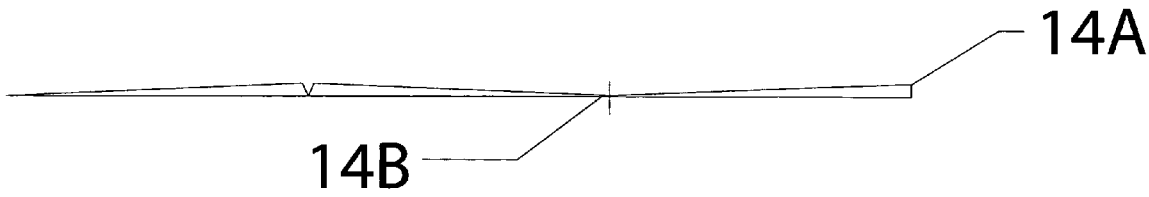
FIG. 4 is a planar view of the top surface of the type B hinge shim and a detailed view thereof.

With particular reference to FIGS. 2 and 4, the shim 11 is gradually and uniformly, linearly tapered from a thicker section 14A to a thinner section 14B, the later being referred to as a feathered end because of its thinness and nearly sharp edge. No discrete boundary between such sections exists except for a short "overlap". Additionally, the shim is molded in one piece.

Each shim has transverse breakable means on the thicker and thinner sections and on the opposite surfaces of each work piece. Additionally, the shims are molded in a sheet of three shims joined such that they can be folded to form a thicker shim as required for application. Thus, they can be used as single or as a pair or as three folded together, forming the thickness of shim required for application.

A set of slots 12A is provided for the hinge mounting screws. When folded into a group of two or three shims, the slots 12 are aligned with each other for ease of inserting the screws. The slots permit the shim(s) to be moved further into the cavity or out toward the hinge's pin to provide a finer adjustment of the door alignment.

The tapered design of the hinge shim, having thinner and thicker sections is to provide additional movement of the door in the jamb for a given thickness. Thus, a hinge shim thickness of 0.050 inches at the thick end will displace the hinge pin approximately 0.060 inches. This additional movement is due to the tapered design of the shim. Additionally, the thinnest section of the shim is typically placed furthest into the cavity under the hinge, thus minimizing the amount of lifting of the hinge at the edge mortised into the door's jamb. This provides a more aesthetically pleasing appearance than a shim of constant thickness, as the shim of constant thickness displaces the edge of the hinge above the surface of the jamb by the amount of the shim thickness.

The shims are designed and manufactured, slightly smaller than the hinge itself. Thus, the shim will easily slip into the cavity under the hinge without the need for trimming to fit the cavity. Additionally, a center slot 12B for the hinge screw is open to the thin edge to permit the shim to be inserted into the cavity without removing the center screw. Rather, the center screw can be loosened one and one half turns and the two screws adjacent to the hinge pin removed and the door moved to open the gap under the hinge and the shim(s) placed into the cavity. Next, the two screws are reinstalled and the center screw tightened.

The shims are molded in sets of three, but can be molded in sets of any number. This set of three can be folded at the score lines or junctions 13 to provide a thicker shim. Each shim is approximately 0.050 inches thick at one end that can move the hinge pin approximately 0.060 inches. Thus, three shims folded together are approximately 0.150 inches thick and will move the hinge pin approximately 0.180 inches. This ability to fold the shims into pairs or a set of three allows for variable and quick adjustment for the alignment of the door. Further, fine adjustments of the hinge can be made by placing the shim further into the cavity.

The shims can provide movement of the hinge pin in either direction. Due to the tapered dimensions of the shim, they can be installed either by inserting the thin edge first into the cavity under the hinge or by alternatively inserting the thick edge first. These two options will move the hinge pin in opposite directions. Thus, the thin edge of the shim is inserted first, if the door to jamb gap, which is opposite from the hinge being adjusted, requires reduction. If the gap is too narrow, then the thick edge can be inserted first, thereby moving the hinge pin in the opposite direction and opening the door to jamb gap.

One particular use of the plastic shim has been disclosed. However, other work pieces, especially tapered ones such as a stake and other items particularly those suited for the building industry, could equally be incorporated by use of the same principles described above. Therefore, although preferred embodiments of the present invention have been shown and described, various modifications and substitutions may be made thereto without departing from the spirit and scope of the invention. Accordingly, it is to be understood that the present invention has been described by way of illustration and not limitation.

CONCLUSION, RAMIFICATIONS, AND SCOPE

The present invention provides an improved plastic hinge shim or work piece useful in the construction industry. The work pieces are of uniform size and shape, of homogeneous consistency, and of dependable quality, so that they do not change with time. Moreover, they are of such dimensions, hardness, and other characteristics as are especially suited for use as a hinge shim or other work piece and which overcome the disadvantages of other types of shims.

Each hinge shim has transverse break lines so that segments can be broken off. Additionally, the hinge shims are molded in a sheet of work pieces such that they can be folded to form a thicker hinge shim as required for application. The hinge shims help in quick alignment of the door in the jamb and avoids the requirement of finishing as a result of sanding or planning.

Although the description above contains much specificity, these should not be construed as limiting the scope of the invention but as merely providing illustrations of some of the presently preferred embodiments of this invention. Thus, the scope of the invention should be determined by the appended claims and their legal equivalents, rather than by the examples given.

What is claimed is:

1. A hinge shimming device comprising a series of connected elongated plastic shims, each of said shims having slots disposed therein, rectangular front and back surfaces, and a thick section terminating in a steeply angled portion along one edge and a thin section along the opposite edge, wherein the shims are connected at a junction formed by one of the thick edge and the thin edge of one shim, and one of the thin edge and the thick edge of an adjacent shim, wherein the shims can be separated cleanly at the junction by pulling individual shims apart, or the shims can be folded at the junction while remaining connected, to form a multi-layer shim with overlapping slots, and wherein either the thick or thin edge of a hinge shim can be inserted between a hinge pin and a door jamb to permit a user to move the hinge pin closer to or away from the door jamb.

2. The device of claim 1, wherein the thin edge of each shim terminates in a sharp edge.

3. The device of claim 1, wherein said device is made of polystyrene, polypropylene, or high impact polystyrene.

4. The device of claim 1, wherein the slots comprise three slots per shim for hinge mounting screws, wherein the slots are elongated in the direction of the thick and thin edges to permit a hinge shim, including multiple overlapping hinge shims, to be adjusted under a hinge to allow door alignment.

5. The device of claim 1, wherein the slots comprise two outer slots disposed toward top and bottom edges of each shim, and one center slot disposed centrally between the top and bottom edges.

6. The device of claim 5, wherein the center slot is open to the thin edge of a shim to permit the shim to be inserted under a hinge without removing the center screw of the hinge.

7. The device of claim 1, wherein said slots comprise four slots disposed evenly between the thick and thin edges, and the top and bottom edges of a shim for receiving hinge screws.

8. A composition of connected elongated plastic hinge shims molded in a sheet of a plurality of detachable shims, each of the shims having opposite, flat, rectangular front and back surfaces and having a thicker edge and an opposite thinner edge, wherein the shims are connected at a junction formed by one of the thicker edge and the thinner edge of one shim, and one of the thicker edge and the thinner edge of an adjacent shim, wherein the shims can be separated cleanly at the junction by pulling individual shims apart, or the shims can be folded at the junction while remaining connected, to from a multi-layer shim with overlapping slots, and wherein a series of slots, elongated toward the thicker and thinner edges are disposed in each of the shims, and wherein a middle slot of said slots is open to the thinner edge of a shim, wherein either the thicker or thinner edge of one or more hinge shims can be inserted under a hinge to permit a user to move a hinge pin either toward or away from a door jamb.

9. The composition set of claim 8 wherein the hinge shims are made of polystyrene, polypropylene, or high impact polystyrene.

10. The composition of claim 8 wherein said middle slot is open to the thinner edge to permit the hinge shim to be inserted under a hinge without removing a hinge's center screw.

* * * * *